US007848694B2

(12) United States Patent
Nakatake et al.

(10) Patent No.: US 7,848,694 B2
(45) Date of Patent: Dec. 7, 2010

(54) IMAGE FORMING DEVICE, PROCESSING UNIT, AND IMAGE FORMING METHOD

(75) Inventors: Naoki Nakatake, Hyougo (JP); Hidekazu Shono, Hyougo (JP)

(73) Assignee: Ricoh Company, Ltd., Tokyo (JP)

( * ) Notice: Subject to any disclaimer, the term of this patent is extended or adjusted under 35 U.S.C. 154(b) by 532 days.

(21) Appl. No.: 11/613,686

(22) Filed: Dec. 20, 2006

(65) Prior Publication Data

US 2007/0147893 A1 Jun. 28, 2007

(30) Foreign Application Priority Data

Dec. 27, 2005 (JP) ..... 2005-375663

(51) Int. Cl.
*G03G 21/00* (2006.01)

(52) U.S. Cl. ..... 399/350; 399/123

(58) Field of Classification Search ..... 399/123, 399/159, 350; 430/110.1, 110.3, 110.4, 111.4
See application file for complete search history.

(56) References Cited

U.S. PATENT DOCUMENTS

| | | | | |
|---|---|---|---|---|
| 6,017,670 | A * | 1/2000 | Hashizume et al. | 430/109.2 |
| 6,203,962 | B1 * | 3/2001 | Itami et al. | 430/119.83 |
| 2002/0021923 | A1 * | 2/2002 | Sato et al. | 399/350 |
| 2005/0196193 | A1 * | 9/2005 | Tamoto et al. | 399/111 |
| 2005/0208411 | A1 * | 9/2005 | Nakayama et al. | 430/109.4 |
| 2006/0140692 | A1 * | 6/2006 | Abe et al. | 399/350 |

FOREIGN PATENT DOCUMENTS

| | | |
|---|---|---|
| JP | 2001-350287 | 12/2001 |
| JP | 2002-351154 | 12/2002 |
| JP | 2003-84476 | 3/2003 |
| JP | 2004-233612 | 8/2004 |
| JP | 2005-62709 | 3/2005 |
| JP | 2005-62830 | 3/2005 |
| JP | 2005-215242 | 8/2005 |

OTHER PUBLICATIONS

U.S. Appl. No. 11/944,868, filed Nov. 26, 2007, Nakatake, et al.
U.S. Appl. No. 12/187,021, filed Aug. 6, 2008, Shono, et al.

* cited by examiner

*Primary Examiner*—David P Porta
*Assistant Examiner*—Benjamin Schmitt
(74) *Attorney, Agent, or Firm*—Oblon, Spivak, McClelland, Maier & Neustadt, L.L.P.

(57) ABSTRACT

An image forming device including toner image forming means that forms toner images on the surface of an image carrier, transfer means that transfers the toner images on the surface of the image carrier onto a transfer member, and a plate shaped cleaning blade. The cleaning blade is configured to contact the surface of the image carrier at a pressure of greater than 40 N/m and to scrape off residual toner remaining on the surface of the image carrier after the transfer process by the transfer means has been completed. The surface of the image carrier has a static coefficient of friction with a sheet as measured by the Euler belt type coefficient of friction measurement method of 0.5 or greater, and the cleaning blade has a static coefficient of friction with a polytetrafluoroethylene tape in the range 1.0 to 2.0.

20 Claims, 6 Drawing Sheets

FIG. 10

| TEST | STATIC COEFFICIENT OF FRICTION OF THE PHOTO-CONDUCTIVE MEMBER | STATIC COEFFICIENT OF FRICTION OF THE CLEANING BLADE | CLEANING PERFORMANCE |
|---|---|---|---|
| TEST 1 | 0.60 | 1.2 | ○ |
| TEST 2 | 0.60 | 1.2 | △ |
| TEST 3 | 0.62 | 1.2 | ○ |
| TEST 4 | 0.50 | 1.2 | ○ |
| TEST 5 | 0.40 | 1.2 | × |
| TEST 6 | 0.50 | 1.0 | ○ |
| TEST 7 | 0.50 | 0.9 | × |
| TEST 8 | 0.60 | 0.5 | × |
| TEST 9 | 0.60 | 2.0 | ○ |
| TEST 10 | 0.60 | 2.1 | COULD NOT BE EVALUATED |

IMAGE FORMING DEVICE, PROCESSING UNIT, AND IMAGE FORMING METHOD

BACKGROUND OF THE INVENTION

1. Field of the Invention

The present invention relates to an image forming device in which a toner image formed on the surface of an image carrier such as a photoconductive member is transferred onto a transfer medium such as a transfer sheet, and then any residual toner after transfer adhering to the surface of the image carrier is scraped off and removed by a cleaning blade. Also, the present invention relates to a process unit used in the image forming device and an image forming method.

2. Description of the Related Art

In recent years it has become difficult to properly clean the residual toner after transfer adhering to the surface of an image carrier such as a photoconductive member using a cleaning blade in this type of image forming device. This is because the toner used in forming images is mainly made by the polymerization method instead of by the pulverization method. Specifically, toner made by the long used pulverization method had large particle diameter, with the average particle diameter in the range ten to several tens of microns, and the average circularity of toner particles was less than 0.9, or irregular shaped. With this type of toner it has become difficult to achieve the high level of dot reproducibility corresponding to the high image quality of recent years.

Therefore in recent years toner made by the polymerization method is mainly used instead of toner made by the pulverization method. The average particle diameter of toner made by the polymerization method is small, at 9 microns or smaller, also the average circularity of toner particles is 0.96 or higher, or almost a true spherical shape. By using this type of toner it is possible to achieve the level of dot reproducibility corresponding to the high image quality of recent years. However, because of the small diameter and spherical shape toner made by the polymerization method can easily roll on the surface of the image carrier and easily pass through the part where the image carrier contacts the cleaning blade. Because of the occurrence of this passing between the image carrier and cleaning blade it is difficult to scrape off the toner by the cleaning blade.

Therefore, in recent years there has been a trend to make the cleaning blade contact the image carrier with a reasonably strong force, so that passing through of spherical toner made by the polymerization method is reduced, and the cleaning performance is increased.

On the other hand, in Japanese Patent Application Laid-open No. 2002-82468 a test is described in which printing is carried out using a photoconductive member having an extremely small coefficient of friction of 0.002 as the image carrier, and with the cleaning blade pressed against the photoconductive member with the extremely high line pressure of 23.0 g/cm. In this test good cleaning of irregular shaped toner made by the pulverization method was possible throughout a long printing period of 25,000 sheets. The reason a photoconductive member with a low coefficient of friction of 0.002 was used was to reduce turning over or wear of the cleaning blade which pressed against the photoconductive member with the extremely high line force of 23.0 g/cm.

However, in this test irregular toner made by the pulverization method was used. In the case of irregular shaped toner which is easy to clean, even if the cleaning blade does not contact with the very high line pressure of 23.0 [g/cm] it is possible to remove the toner sufficiently from the photoconductive member. Specifically, in order that the toner can be cleaned well from the photoconductive member using a cleaning blade (hereafter referred to simply as a blade), it is necessary that the blade in contact with the photoconductive member properly traps the toner on the photoconductive member. In the case of small diameter spherical shaped toner made by the polymerization method, there is a gap between the photoconductive member and the blade in contact with the photoconductive member, through which the spherical shaped toner can pass. Also, the spherical shaped toner can easily roll in this gap, until it eventually passes between the area of contact of the photoconductive member and the blade. Therefore, when using spherical shaped toner, the blade is pressed against the photoconductive member with extremely high pressure, to make the gaps formed between the photoconductive member and the blade as small as possible. However, in the case of large diameter irregular shaped toner made by the pulverization method, even if there is a slight gap between the photoconductive member and the blade in contact with it, the blade can trap the irregular shaped toner well. It depends on the material of the blade, but if the line pressure of the blade is set to about 10 [g/cm], it is possible to clean irregular shaped toner sufficiently. Therefore, in this test it can be said that the irregular toner made by the pulverization method was cleaned from the photoconductive member with the cleaning blade contacting the photoconductive member with an excessively high line pressure.

In the case of using spherical shaped toner made by the polymerization method, the blade line pressure of 23.0 [g/cm] in this test is not such a high value. However, in this test, to prevent turning over of the blade that contacts the photoconductive member with this line pressure, a photoconductive member with an extremely small surface coefficient of friction was used (surface coefficient of friction=0.002). The two inventors discovered that using this type of photoconductive member it was not possible to clean spherical shaped toner well, for a reason that is explained as follows.

In other words, in order to properly clean the toner with a blade, in addition to properly trapping the toner on the photoconductive member with the blade, it is necessary that the toner that is accumulated successively on the surface of the blade drops from the surface of the blade. This is because if the accumulated toner does not drop from the surface of the blade the cleaning is not complete. The main factor to make the accumulated toner drop from the surface of the blade is vibrations of the blade. Therefore it is desirable that the blade vibrates vigorously, to make the accumulated toner drop from the surface of the blade. However, in the case of irregular toner made by the pulverization method, due to the irregular shape comparatively large gaps are formed between the individual particles of toner, so the accumulated toner on the blade is in a state that is easily broken down. Therefore, even if the blade does not vibrate so much, the toner accumulated on the blade can easily fall off the surface of the blade.

However, in the case of spherical toner made by the polymerization method, it is difficult to form gaps between the individual particles of toner, so the toner accumulated on the blade is in a state that is difficult to break down. Therefore, if the blade does not vibrate vigorously the accumulated toner cannot be effectively forced to drop off the surface of the blade, so the toner accumulated on the surface of the blade increases to a certain amount. Also, the increased amount of accumulated toner presses the blade upwards, and passes between the blade and the photoconductive member. In this test, a special photoconductive member with an extremely low surface coefficient of friction (0.002) was used, so it is not possible to make the blade that is in contact with the photoconductive member vibrate well. Therefore, when using spherical toner made by the polymerization method the toner accumulated on the surface of the blade grows to a certain size, which causes the accumulated toner to pass through the blade and the photoconductive member.

Technologies relating to the present invention are also disclosed in, for example, Japanese Patent Application Laid-open No. 2001-350287 and Japanese Patent Application Laid-open No. 2005-215242.

SUMMARY OF THE INVENTION

With the foregoing background in view, it is an object of the present invention to provide an image forming device, a processing unit using this image forming device, and an image forming method in which even if spherical toner made by the polymerization method is used, it is possible to clean the toner well using a cleaning blade.

In an aspect of the present invention, an image forming device comprises a toner image forming device that forms toner images on the surface of an image carrier; a transfer device that transfers the toner images on the surface onto a transfer member; and a removal device that removes residual toner remaining on the surface after the transfer process by the transfer device has been completed. A plate shaped cleaning blade that contacts the surface to scrape off the toner on the surface is used as the removal means, and an image carrier having a static coefficient of friction with a sheet as measured by the Euler belt type coefficient of friction measurement method of 0.5 or greater is used as the image carrier, and a cleaning blade having a static coefficient of friction with a polytetrafluoroethylene tape in the range 1.0 to 2.0 is used as the cleaning blade.

In another aspect of the present invention, a process unit in an image forming device comprises a toner image forming device that forms toner images on an image carrier, a transfer device that transfers the toner images on the surface onto a transfer member, and a removal device that removes residual toner remaining on the surface after the transfer process by the transfer device has been completed. A plate shaped cleaning blade that contacts the surface to scrape off the toner on the surface is used as the removal device. The process unit is inserted into and removed from a main body of the image forming device as a single unit comprising at least the image carrier and the removal means held in a common holding member. An image carrier having a static coefficient of friction with a sheet as measured by the Euler belt type coefficient of friction measurement method of 0.5 or greater is used as the image carrier. A cleaning blade having a static coefficient of friction obtained based on the measurement result of static friction force using a digital push-pull gauge in the range 1.0 to 2.0 is used as the cleaning blade.

In another aspect of the present invention, an image forming method comprises a toner image forming step of forming toner images on the surface of an image carrier; a transfer step of transferring the toner images on the surface onto a transfer member; and a removal step of removing residual toner remaining on the surface after the transfer step has been completed. The toner on the surface is scraped off by a plate shaped cleaning blade which contacts the surface. An image carrier having a static coefficient of friction with a sheet as measured by the Euler belt type coefficient of friction measurement method of 0.5 or greater is used as the image carrier. A cleaning blade having a static coefficient of friction obtained based on the measurement result of static friction force using a digital push-pull gauge in the range 1.0 to 2.0 is used as the cleaning blade.

BRIEF DESCRIPTION OF THE DRAWINGS

The above and other objects, features, and advantages of the present invention will become more apparent from the following detailed description taken with the accompanying drawings, in which:

FIG. 10 is a diagram showing the results of each of tests 1 through 10 of the present embodiment.

DESCRIPTION OF THE PREFERRED EMBODIMENTS

The following is an explanation of an embodiment of an electronic photograph printer (hereafter simply referred to as the printer) as an image forming device that applies the present invention.

Figure 1:
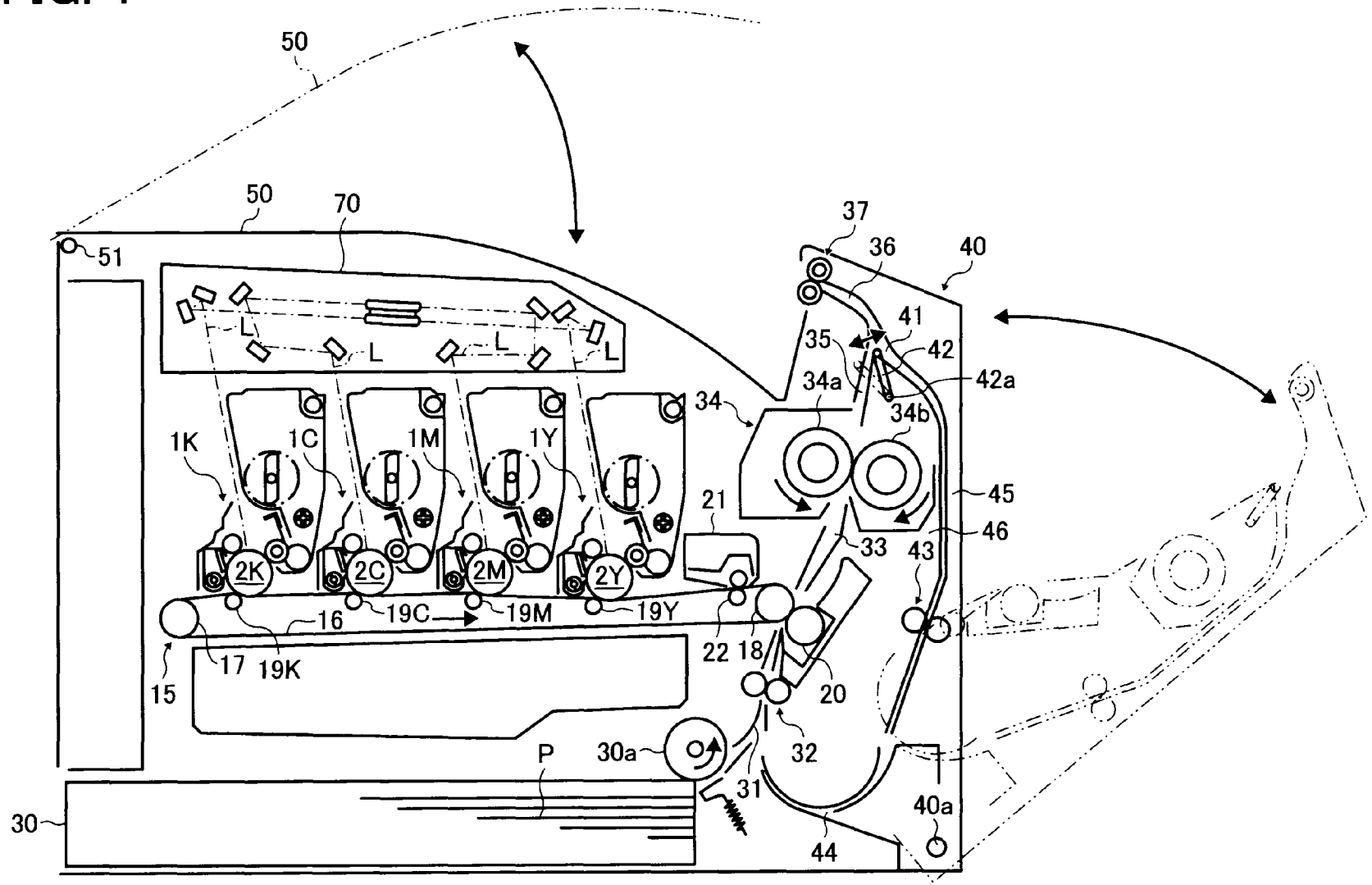
FIG. 1 is a diagram that shows the schematic configuration of a printer according to an embodiment of the present invention.
Figure 2:
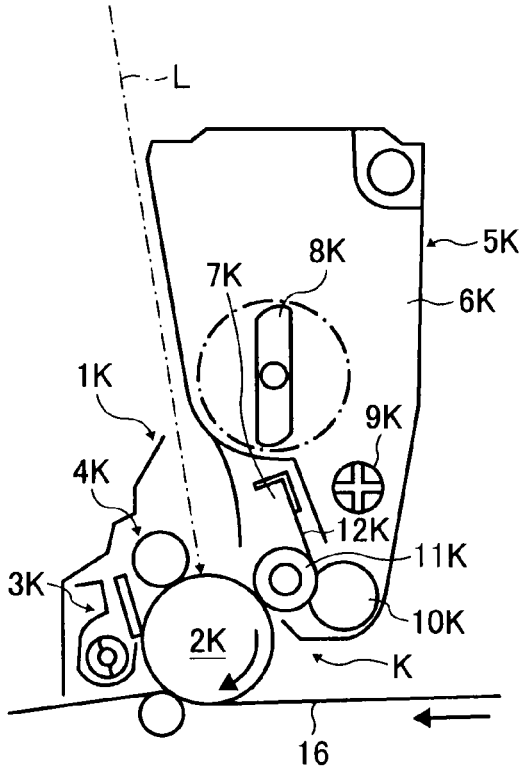
FIG. 2 is a diagram that shows the configuration of the K process unit and developing device of this printer.

First, the basic configuration of the printer is explained. FIG. 1 shows the schematic configuration of the printer. In the figure, the printer includes four toner image forming units that form yellow, magenta, cyan, and black toner images (hereafter indicated as Y, M, C, and K). These toner image forming units each include a process unit and a developing unit. Taking as an example the K toner image forming unit that forms K toner images, the K toner image forming unit includes a K process unit 1K and a K developing unit 5K, as shown in FIG. 2.

The K process unit 1K includes a drum shaped photoconductive member 2K that is the image carrier, a drum cleaning device 3K, a decharging device (not shown in the drawings), a charging device 4K, and so on, that are held in a casing that is a common support member. The K process unit 1K can be inserted into and removed from the printer as one unit.

The photoconductive member 2K is rotated in the clockwise direction by drive means that is not shown in the drawings. The charging device 4K uniformly charges the surface of the photoconductive member 2K that is being rotated in this way. The surface of the uniformly charged photoconductive member 2K is scanned by exposure to laser light L to form a K electrostatic latent image. The K electrostatic latent image is developed using K toner by the developing device 5K to form a K toner image. The K toner image is then transferred onto an intermediate transfer belt 16 that is described later. The drum cleaning device 3K removes residual toner after transfer adhering to the surface of the photoconductive member 2K after the intermediate transfer process. Also, the decharging device that is not shown on the drawings removes any remaining electrical charge on the photoconductive member 2K after cleaning. After decharging, the surface of the photoconductive member 2K is initialized and ready for the next image formation. In the other color process units also (1Y, M, C), (Y, M, C) toner images are formed on the photoconductive member (2Y, M, C) in the same way, and transferred onto the intermediate transfer belt 16 that is described later.

The developing device 5K includes an oblong hopper unit 6K that houses K toner that is not shown in the drawings, and a developing unit 7K. Within the hopper 6K an agitator 8K that is rotated by drive means not shown in the drawings is disposed, below which in the vertical direction an agitation paddle 9K that is rotated by rotation means not shown in the drawing is disposed, below which a toner supply roller 10K that is rotated by rotation means not shown in the drawing is disposed. The K toner within the hopper 6K is agitated by the rotation of the agitator 8K and the agitation paddle 9K and moves towards the toner supply roller 10K under its self weight. The toner supply roller 10K includes a metal core made of metal and a roller portion made from foamed resin or the like that covers the surface of the metal core. As the toner supply roller 10K rotates the K toner in the hopper 6K adheres to the surface of the roller portion of the toner supply roller 10K.

The developing unit 7K of the developing device 5K includes a developing roller 11K that rotates while contacting the photoconductive member 2K and the toner supply roller 10K, a thin laminated blade 12K whose tip contacts the surface of the developing roller 11K, and so on. The K toner adhering to the toner supply roller 10K within the hopper 6K is supplied to the surface of the developing roller 11K at the area of contact between the developing roller 11K and the toner supply roller 10K. When the supplied K toner passes the position of contact of the thin laminated blade 12K and the developing roller 11K as the developing roller 11K rotates, the thickness of the layer on the surface of the roller is controlled. Then the K toner whose layer thickness has been controlled adheres to the K electrostatic latent image on the surface of the photoconductive member 2K at the developing area which is the area of contact between the developing roller 11K and the photoconductive member 2K. By adhering in this way the K electrostatic latent image is developed into the K toner image.

The K toner image forming unit has been explained using FIG. 2, but Y, C, and M toner images are formed on the surfaces of the photoconductive members 2Y, M, C by a similar process in the Y, C, and M toner image forming units.

In FIG. 1 which was described earlier, an optical writing unit 70 is disposed above the four toner image forming units. The optical writing unit 70 is means for writing latent images that optically scans the photoconductive members 2Y, M, C, K of the process units 1Y, M, C, K with laser light L emitted from a laser diode based on image information. As a result of this optical scan, Y, M, C, and K electrostatic latent images are formed on the photoconductive members 2Y, M, C, K. The optical writing unit 70 irradiates the photoconductive member with laser light (L) generated by a light source via a plurality of optical lenses and mirrors while polarizing the light in the main scan direction by a polygon mirror rotated by a polygon motor that is not shown in the drawings.

A transfer unit 15 is disposed below the four toner image forming units in which the endless intermediate transfer belt 16 is mounted that moves endlessly in the counterclockwise direction in the figure. Besides the intermediate transfer belt 16, the transfer unit 15, which is transfer means, includes a drive roller 17, a driven roller 18, four primary transfer rollers 19Y, M, C, K, a secondary transfer roller 20, a belt cleaning device 21, a cleaning back up roller 22, and so on.

The intermediate transfer belt 16 is mounted on the drive roller 17, the driven roller 18, the cleaning back up roller 22, and the four primary transfer rollers 19Y, M, C, K that are disposed on the inside of the loop of the intermediate transfer belt 16. Then when the drive roller 17 is driven to rotate in the counterclockwise direction by drive means not shown in the drawings, the intermediate transfer belt 16 is moved endlessly in the same direction.

The endless intermediate transfer belt 16 is sandwiched between the four primary transfer rollers 19Y, M, C, K and the photoconductive members 2Y, M, C, K. By being sandwiched in this way, Y, M, C, and K primary nips are formed where the outer surface of the intermediate transfer belt 16 and the photoconductive members 2Y, M, C, K contact.

A primary transfer bias is applied to the primary transfer rollers 19Y, M, C, K by a transfer bias power source that is not shown in the drawings. In this way a transfer electric field is formed between the electrostatic latent images of the photoconductive members 2Y, M, C, K and the primary transfer rollers 19Y, M, C, K. Instead of the primary transfer rollers 19Y, M, C, K a transfer charger or a transfer brush or similar may be used.

The Y toner image formed on the surface of the photoconductive member 2Y of the Y process unit 1Y is brought into the Y primary transfer nip by the rotation of the photoconductive member 2Y, and primary transfer is carried out from the photoconductive member 2Y to the intermediate transfer belt 16 by the action of the transfer electric field and the nip pressure. In this way, when the Y toner image that is transferred to the intermediate transfer belt 16 passes the M, C, K primary transfer nips due to the endless movement of the intermediate transfer belt 16, the M, C, K toner images on the photoconductive members 2M, C, K are successively superposed on the Y toner image. As a result of this superposition brought about by the primary transfer, a four color toner image is formed on the intermediate transfer belt 16.

The secondary transfer roller 20 of the transfer unit 15 is disposed to the outside of the loop of the intermediate transfer belt 16. The intermediate transfer belt 16 is sandwiched between the secondary transfer roller 20 and the driven roller 18 on the inside of the loop. As a result of being sandwiched in this way, a secondary transfer nip is formed where the outside surface of the intermediate transfer belt 16 and the secondary roller 20 contact. A secondary transfer bias is applied to the secondary transfer roller 20 by a transfer bias power source that is not shown in the drawings. As a result of this bias, a secondary transfer electric field is formed between the secondary transfer roller 20 and the driven roller 18 which is connected to ground.

Below the transfer unit 15 a sheet supply cassette 30 that houses recording sheets Pin the form of a bundle of a plurality of superimposed sheets. The sheet supply cassette 30 is disposed so that it can be installed and removed by sliding relative to the body of the printer. A supply roller 30*a* contacts the uppermost recording sheet P in the bundle in the sheet supply cassette 30, and at a specific timing the supply roller 30*a* rotates in the counterclockwise direction in the figure, and transmits the recording sheet P toward a sheet supply path 31.

A pair of register rollers 32 is disposed near an end of the sheet supply path 31. When a recording sheet P transmitted from the sheet supply cassette 30 is sandwiched between the pair of rollers, rotation of the two rollers stops immediately. Then at a timing that synchronizes the sandwiched recording sheet P with the four color toner image on the intermediate transfer belt 16 within the secondary transfer nip the register rollers 32 are rotated again to transmit the recording sheet P towards the secondary transfer nip.

Secondary transfer of the four color toner image on the intermediate transfer belt 16 that is brought into close contact with the recording sheet P at the secondary nip is carried out in one operation onto the recording sheet P under the effect of the secondary transfer electric field and the nip pressure. Coupled with the white color of the recording sheet P a full color toner image is created. When the recording sheet P on the surface of which the full color toner image has been formed has passed through the secondary transfer nip, the recording sheet P separates from the secondary transfer roller 20 and the intermediate transfer belt 16 by curvature separation. The recording sheet P is then transferred to a fixing device 34 that is described later via a post-transfer transport path 33.

Residual toner that was not transferred onto the recording sheet P adheres to the intermediate transfer belt 16 after passing through the secondary transfer nip. This residual toner is cleaned from the belt surface by the belt cleaning device 21 that contacts the outer surface of the intermediate transfer belt 16. The cleaning back up roller 22 disposed on the inside of the loop of the intermediate transfer belt 16 is a back up for the belt cleaning by the belt cleaning device 21 from the inside of the loop.

The fixing device 34 forms a fixing nip with a fixing roller 34*a* that includes a heat generation source such as a halogen lamp, which is not shown in the drawings, and a pressure roller 34*b* that rotates while contacting the fixing roller 34*a* with a predetermined pressure. The recording sheet P that is passed into the fixing device 34 is sandwiched in the fixing nip so that the surface carrying the unfixed toner image comes into close contact with the fixing roller 34*a*. Then, the toner in the toner image softens under the effect of the heating and pressure, and the full color image is fixed.

The recording sheet P discharged from within the fixing device 34 passes through a post-fixing transport path 35, and approaches the branch point of a sheet discharge path 36 and a pre-reversal transport path 41. A switching claw 42 that is driven to rotate about a rotation shaft 42*a* as center is disposed to the side of the post-fixing transport path 35. By rotation of the switching claw 42 the post-fixing transport path 35 is closed and opened near the end of the post-fixing transport path 35. At the timing that the fixing device 34 discharges the recording sheet P the switching claw 42 stops at the rotation position indicated by the full line in the figure, so the post-fixing transport path 35 is opened near the end. Therefore, the recording sheet P passes from the post-fixing transport path 35 into the sheet discharge path 36, and is sandwiched between a pair of sheet discharge rollers 37.

In the event that single side printing is set by input operations at an operation unit that includes alphanumeric keys or the like which are not shown in the drawings, or control signals transmitted from a personal computer or the like which is not shown on the drawings, the recording sheet P that is sandwiched between the pair of sheet discharge rollers 37 is discharged as it is to the outside of the printer. The recording sheet P is then stacked in a stacking unit which is the top surface of a top cover 50 of the body.

On the other hand, in the event that the double sided printing mode has been set, when the rear end of the recording sheet P has passed out of the post-fixing transport path 35 into the sheet discharge path 36 while the front end is sandwiched between the pair of sheet discharge rollers 37, the switching claw 42 rotates to the position indicated by the broken line in the figure, so the post-fixing transport path 35 is closed near the end. At about the same time the sheet discharge rollers 37 start to rotate in the reverse direction. Then, the recording sheet P is transported with the rear side to the front into the pre-reversal transport path 41.

FIG. 1 shows this printer from the front side. The near side of the direction at right angles to the plane of the paper is the front surface of the printer, and the far side is the rear surface. Also, in the figure the right side of the printer is the right side surface, and the left side is the left side surface. The right end of the printer includes a reversal unit 40 that can open and close with respect to the main body by rotating about a rotation axis 40*a* as center. When the pair of sheet discharge rollers 37 rotates in the reverse direction, the recording sheet P passes through the pre-reversal transport path 41 of the reversal unit 40, and is transported in the vertical direction from the top side to the bottom side. Then the recording sheet P passes between a pair of reverse transport rollers 43 then into a semi-circular shaped curved reverse transport path 44. Furthermore, when the recording sheet P is transported along the curved shape the top and bottom surfaces are reversed, and the direction of movement in the vertical direction from the top side to the bottom side is also reversed, and the recording sheet P is transported in the vertical direction from the bottom side to the top side. Thereafter, the recording sheet P passes through the sheet supply path 31 and again enters the secondary transfer nip. Then secondary transfer of a full color image is carried out onto the second surface of the recording sheet P in one operation. Then the recording sheet P passes successively through the post-transfer transport path 33, the fixing device 34, the post-fixing transport path 35, the sheet discharge path 36, and the pair of sheet discharge rollers 37, and is discharged to the outside of the printer.

The reversal unit 40 includes an external cover 45 and a pivoting body 46. Specifically, the external cover 45 of the reversal unit 40 is supported so that the external cover 45 can rotate about the rotation axis 40*a* as center provided in the main body of the printer. By this rotation the external cover 45 can open and close with respect to the main body, together with the pivoting body 46 that is supported within the external cover 45. As shown by the broken line in the figure, when the external cover 45 is opened together with the internal pivoting body 46, the sheet supply path 31 formed between the reversal unit 40 and the main body of the printer, the secondary transfer nip, the post-transfer transport path 33, the fixing nip, the post-fixing transport path 35, and the sheet discharge path 36 are divided vertically in two, and exposed to the exterior. In this way, any jammed sheets in the sheet supply path 31, the secondary transfer nip, the post-transfer transport path 33, the fixing nip, the post-fixing transport path 35, and the sheet discharge path 36 can be easily removed.

Also, the pivoting body 46 is supported by the external cover 45 so that when the external cover 45 is open the pivoting body 46 pivots about a pivot axis (not shown in the drawings) as center provided in the external cover 45. As a result of this pivoting action, the pivoting body 46 opens with respect to the external cover 45, and the pre-reversal transport path 41 and the reverse transport path 44 are divided vertically in two parts. In this way, any jammed sheets in the pre-reversal transport path 41 or the reverse transport path 44 can be easily removed.

The top cover 50 of the printer body is supported so that it can freely rotate about a pivot axis 51, as shown by the arrow symbols in the figure. By rotating the top cover 50 in the counterclockwise direction in the figure the top cover 50 is opened with respect to the body. Also, the top aperture of the body is exposed to the exterior. In this way, the optical writing unit 70 is exposed.

Figure 3:
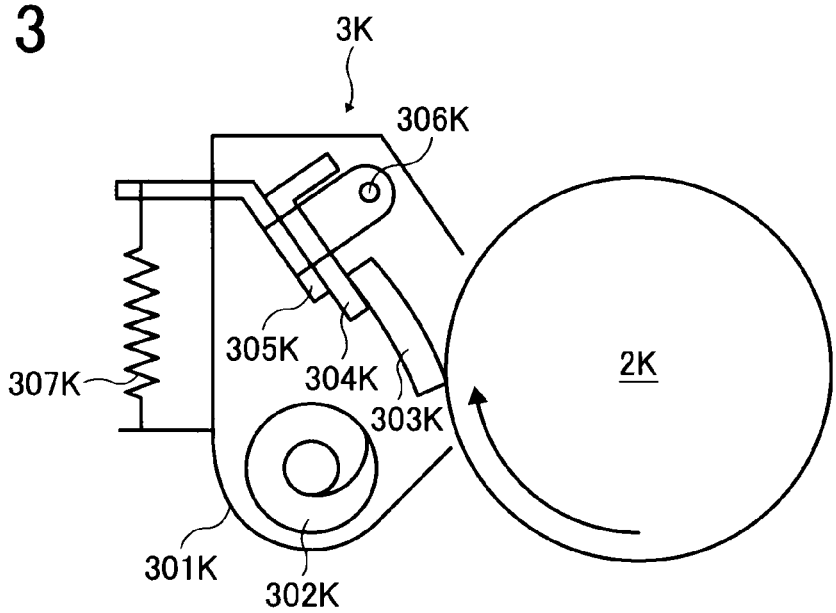
FIG. 3 is a diagram that shows the configuration of the photoconductive member and drum cleaning device in the process unit.

FIG. 3 is an enlarged configuration diagram showing the photoconductive member 2K and the drum cleaning device 3K in the K process unit 1K. In FIG. 3, the drum cleaning device 3K which is the removal means that removes toner adhering to the surface of the photoconductive member 2K which is the image carrier includes a recovering screw 302K, a cleaning blade 303K, and other members held within a casing 301K. The cleaning blade 303K is made from an elastic material, with one end fixed to a support plate 304K and supported as a cantilever. The edge of the free end of the cleaning blade 303K contacts the photoconductive member 2K.

The support plate 304K that supports the cantilevered cleaning blade 303K is fixed to an arm 305K. The arm 305K can pivot about a pivot axis 306K as center, but a rotational force in the counterclockwise direction in the figure is applied by the tension force of a coil spring 307K. In this way a rotational force that is counterclockwise in the figure with the rotation axis 306K as center is applied to the cleaning blade 303K that is supported by the arm 305K via the support plate 304K. However, after rotating through a certain angle the edge of the blade contacts the photoconductive member 2K. Also the cleaning blade 303K contacts the photoconductive member 2K with a predetermined pressure.

The toner remaining after transfer which is scraped off from the surface of the photoconductive member 2K by the cleaning blade 303K drops onto the recovery screw 302K that is disposed directly below the arm 305K. The recovery screw 302K is rotated by rotation means that is not shown on the drawings, and transports the toner remaining after transfer in the direction of the screw axis, and discharges the toner outside the drum cleaning device 3K. The discharged toner remaining after transfer is transported to a waste toner bottle by transport means that is not shown in the drawings.

Figure 4:
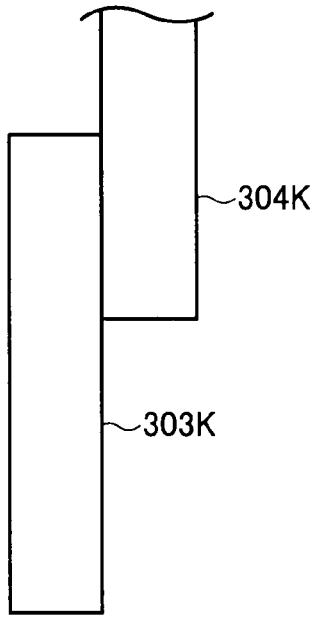
FIG. 4 is a schematic diagram showing the support plate and cleaning blade in the drum cleaning device.

The cleaning blade 303K is fixed to the support plate 304K by adhesive, as shown in FIG. 4. The support plate 304K may be made using metal, plastic, ceramic, or the like. In particular a certain amount of pressure is applied, so a plate made from a metal such as stainless steel plate, aluminum plate, or phosphor bronze is desirable.

Figure 5:
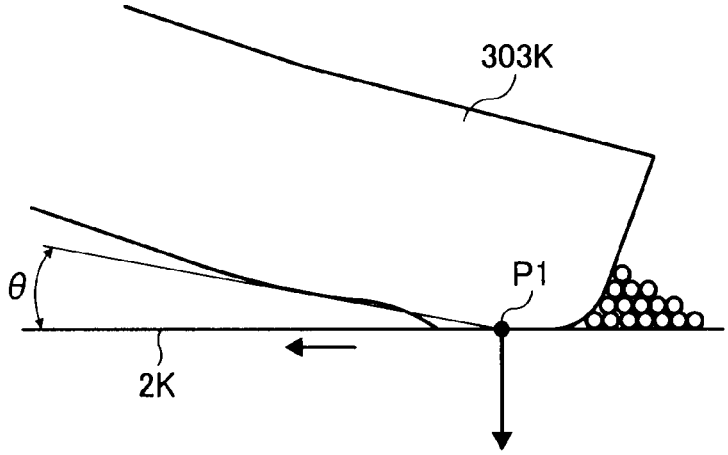
FIG. 5 is a schematic diagram showing the tip of the cleaning blade and the photoconductive member.

Also, as shown in FIG. 5, the cleaning blade 303K contacts the photoconductive member 2K at a contact angle θ. The contact angle θ is the angle between the contact line of the edge of the cleaning blade 303K with respect to the point of contact P1 with the photoconductive member 2K and the line extending downstream in the direction of movement of the surface of the photoconductive member from the point of contact P1 on the surface of the photoconductive member 2K in opposition to the cleaning blade 303K.

The material used in the cleaning blade 303K has a JIS A hardness of 60 to 80 degrees, a percentage elongation of 300 to 350%, a percentage permanent elongation of 1.0 to 5.0%, a modulus of 100 to 350 kg/cm$^2$, and a percentage rebound resilience of 10 to 40%. Examples of materials that may be used include urethane resins, styrene resins, olefin resins, vinyl chloride resins, polyester resins, polyamide resins, fluorine resins, and so on.

Here, "elongation" is a type of strain, and is the deformation when tension is applied to a test specimen. The "percentage elongation" is the value of the length of a test specimen when subject to tension divided by the original length and multiplied by 100 (%). The elongation may be measured in accordance with JIS K 6301.

Also, the "permanent elongation" is a type of permanent strain. The "percentage permanent elongation" is the percentage elongation remaining permanently in a material after a tension load is applied to the material and the load is then removed. For plastic materials, a tension load is applied to a dumbbell shaped test specimen and extended to a specified percentage elongation. After holding in this condition for ten minutes the load is rapidly removed. After leaving for ten minutes the percentage elongation with respect to the original length is obtained, which is the percentage permanent elongation (%) (JIS K 6301).

Also, "rebound resilience" is a property of vulcanized rubber that receives energy in mechanical deformation, which is released when the deformed state rapidly recovers. A weight. W is dropped from a height h0, impacts the rubber at height 0 on a floor or the like, and rebounds to a height h1. The rebound resilience is given by the value of h0/h1.

Also, the modulus is a tensile stress. For example, a 100% modulus (100% M) is the stress required to extend rubber to twice the original length. Polyurethane is slow to recover from extension, so the value gradually increases immediately after extending it (after extension it does not soon shrink to the original size).

Using FIGS. 3 through 5 the configuration of the K drum cleaning device 3K has been explained, but the drum cleaning device for the other colors has the same configuration.

Next, each test carried out by the inventors will be explained.

[Test 1]

First the K photoconductive member 2K was manufactured. A cut aluminum pipe of thickness 1 mm was used as the base of the photoconductive member 2K. Then the surface of the base was covered with a lower layer. Specifically, first the following constituents were placed in a ball mill, and a mixing process was carried out for 48 hours. In this way the dispersion liquid for the lower layer was obtained.

| | |
|---|---|
| Titanium dioxide powder | 15 parts by mass |
| Alcohol soluble nylon resin | 3 parts by mass |
| Methyl ethyl ketone | 75 parts by mass |

Next, the dispersion liquid was diluted with 75 parts methyl ethyl ketone, and the coating liquid to be applied for the lower layer was obtained. This coating liquid was applied to the surface of the aluminum by the dipping coating method, then dried for 20 minutes at 120° C. In this way, when the thickness of the formed lower layer was measured, it was found to be 2 μm.

The lower layer was covered by a charge generation layer. Specifically, first the following constituents were placed in a ball mill, and a mixing process was carried out for 72 hours.

Figure 6:
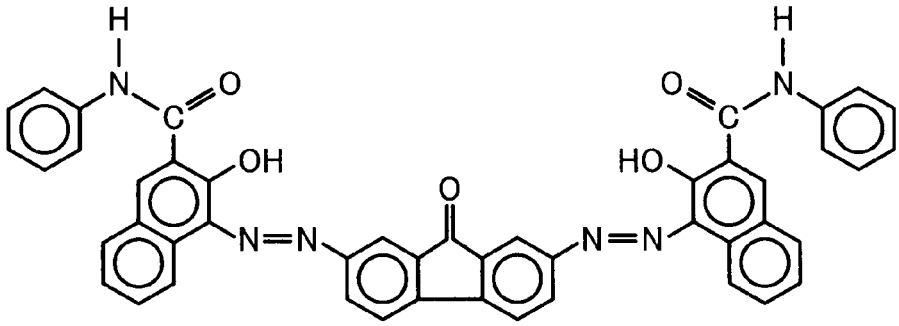
FIG. 6 is a diagram showing the structural formula of the charge generation material.

| | |
|---|---|
| The charge generation material indicated by the structural formula in FIG. 6 | 10 parts by mass |
| Poly vinyl butyral | 7 parts by mass |
| Tetrahydrofuran | 145 parts by mass |

After adding 200 parts by mass of cyclohexanone to the dispersion liquid obtained from the mixing process, the mixing process was carried out for a further one hour. After processing, the liquid mixture was diluted with an appropriate amount of cyclohexanone, to obtain the coating liquid. After this coating liquid was applied above the lower layer using the dipping coating method, the coating was dried for ten minutes at 100° C. and the charge generation layer was obtained.

A method that is different from the method explained here may be used as the method for forming the charge generation layer. For example, as the charge generation material, for example C.I. pigment blue 25 (color index C.I. 21180), C.I. pigment red 41 (C. I. 21200), C. I. acid red 52 (C. I. 45100), C. I. basic red 3 (C. I. 45210), azo pigments having a carbazole skeleton, azo pigments having a distyrylbenzene skeleton, azo pigments having a triphenylamine skeleton, azo pigments having a dibenzothiofen skeleton, azo pigments having an oxadiazole skeleton, azo pigments having a fluorenone skeleton, azo pigments having a bis-stilbenzene skeleton, azo pigments having a distyryloxadiazole skeleton, azo pigments having a distyrylcarbazole skeleton, and other azo pigments, C. I. pigment blue 16 (C.I. 74100) and other phthalocyanine pigments, C. I. vat brown 5 (C. I. 73410), C. I. vat dye (C. I. 73030), and other indigo pigments, algol scarlet 5 (manufactured by Bayer Co.), indanthrene scarlet R (manufactured by Bayer Co.), and other perylene pigments, stearic paints, hexagonal Se powder, and so on may be used. These charge generation substances may be pulverized and dispersed with a solvent such as tetrahydrofuran, cyclohexanone, dioxane, dichloroethane, in a ball mill, an attriter, a sand mill, or similar method. At this time, a resin such as for example polyamide, polyurethane, polyester, epoxy resin, polyketone, polycarbonate, silicone resin, acrylic resin, poly vinyl butyral, poly vinyl formal, poly vinyl ketone, polystyrene, poly (N-vinylcarbazole), or poly-acrylamide may be added as a binding material.

A charge transport layer was laid on top of the charge generation layer. Specifically, first a coating liquid made from the following constituents was mixed.

Figure 7:
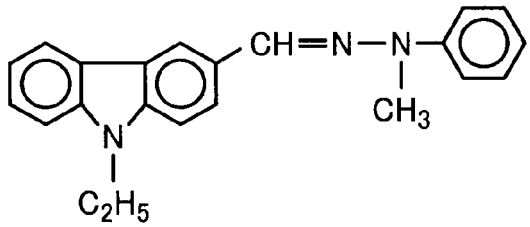
FIG. 7 is a diagram showing the structural formula of the charge transport material.

| | |
|---|---|
| The charge transporting material with the structural formula shown in FIG. 7: | 7 parts by mass |
| Polycarbonate: (Panlight C-1400, made by Teijin Ltd.) | 10 parts by mass |
| Tetrahydrofuran: | 83 parts by mass |
| Silicone oil: | 0.001 parts my mass |

After applying this coating liquid on top of the charge generation layer by the dipping coating method, the coating was dried for 30 minutes at 120° C. to obtain the charge transport layer. This charge transport layer was found to be 24 μm thick by measurement.

A method that is different from the method explained here may be used as the method for forming the charge transport layer. For example, as the charge transport material, a compound having in the main chain or in the side chain a polycyclic aromatic compound such as anthracene, pyrene, phenanthrene, or coronene, or a nitrogen containing cyclic compound such as indole, carbazole, oxazole, isooxazole, thiazole, amidazole, pyrazole, oxadiazole, pyrazoline, thiadiazole, or triazole, a triphenylamine compound, a hydrazone compound, or an α-phenyl stilbene compound may be used. Also, as the polymer compound that is the binder component in the charge transport layer a thermoplastic or thermosetting resin such as polystyrene, styrene/acrylonitrile copolymer, styrene/butadiene copolymer, styrene/anhydrous maleic acid copolymer, polyester, poly vinyl, poly vinyl chloride, vinyl chloride/vinyl acetate copolymer, poly vinyl acetate, poly vinylidene chloride, polyarylate, polycarbonate, cellulose acetate resin, ethyl cellulose resin, poly vinyl butyral, poly vinyl formal, poly vinyl toluene, acrylic resin, silicone resin, fluorine resin, epoxy resin, melamine resin, urethane resin, phenol resin, or alkyd resin may be used. Among these, polystyrene, polyester, polyarylate, and polycarbonate have good charge transport properties, and are very useful.

Here the formation of an organic photoconductive layer that is a lamination of a charge generation layer and a charge transport layer has been explained, but a single layer type may also be used. Also, a protective layer may be provided on the surface of the photoconductive member. The purpose of the protective layer is to improve the mechanical strength, and it is desirable that this should contain high molecular weight charge transport substance, low molecular weight charge transport substance, or a cross-linked charge transport substance containing a reactive hydroxyl radical. In particular, if a cross-linked charge transport substance containing a reactive hydroxyl radical is contained, the mesh structure of the protective layer is fine, and it is possible to effectively increase the mechanical strength.

Specific examples of the cross-linked charge transport substance containing a reactive hydroxyl radical include the bisphenol compound disclosed in Japanese Patent Application Laid-open No. H7-228557, the diamine compound disclosed in Japanese Patent Application Laid-open No. H8-198825, the diamine compound containing a dihydroxyl radical disclosed in Japanese Patent Application Laid-open No. H9-31035, Japanese Patent Application Laid-open No. H9-263569, Japanese Patent Application Laid-open No. H9-268164, and Japanese Patent Application Laid-open No. H10-7629, the amine compound containing the hydroxyl radical disclosed in Japanese Patent Application Laid-open No. H9-278723 and Japanese Patent Application Laid-open No. H10-7630, the stilbene compound containing the hydroxyl radical disclosed in Japanese Patent Application Laid-open No. H9-194442, and the amine compound disclosed in Japanese Patent Application Laid-open No. H10-53569. These materials all have excellent charge transport properties, and good reactivity. Also, the reactive charge transport material given as an example in Japanese Patent Application Laid-open No. 2001-142243 and Japanese Patent Application Laid-open No. 2002-6517 may be used.

The inventors adjusted the static coefficient of friction of the surface of the photoconductive member 2K made by them so that the measurement result in accordance with the Euler type coefficient of friction measurement method was 0.6. Specifically, by adjusting the quantity of silicone oil contained in the charge transport layer the static coefficient of friction of the surface of the photoconductive member 2K was adjusted to 0.6.

Figure 8:
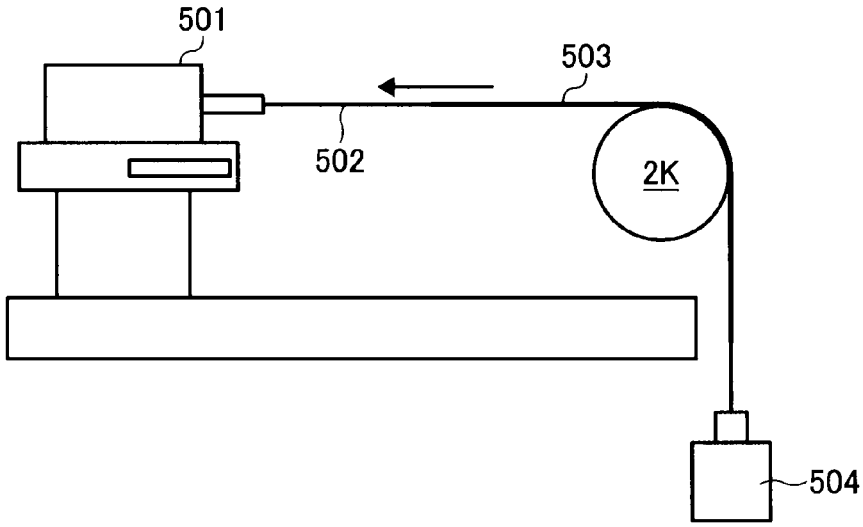
FIG. 8 is a schematic diagram showing a measurement device that uses the Euler belt type coefficient of friction measurement method.

For the Euler type coefficient of friction measurement method the measurement equipment shown in FIG. 8 was prepared. A digital push-pull gauge 501 as a force gauge was attached to a line 502, and an end of the line 502 was attached to high quality paper 503. At this time high quality paper (Ricoh Co. Ltd. type 6200 A4T) 503 was fitted with the papermaking direction aligned to the direction of the line. Then the high quality paper 503 was wrapped around ¼ of the total perimeter of the photoconductive member 2K as shown in the figure, and a 0.98 N (100 g) weight 504 was attached to the end of the high quality paper 503. In this way, tension was applied to the high quality paper 503. When the measurement preparations were made in this way, the motor of the digital push-pull gauge 501 was driven, and tension was applied to the force gauge. Then, after reading the tension force at the time just before the high quality paper 503 started to slip on the surface of the photoconductive member 2K, the static coefficient of friction μs was calculated based on the result of the reading (F). At this time, the calculation formula $\mu s=2/\pi\times \ln(F/0.98)$ was used (where, F is the tension force reading result [N]).

Figure 9:
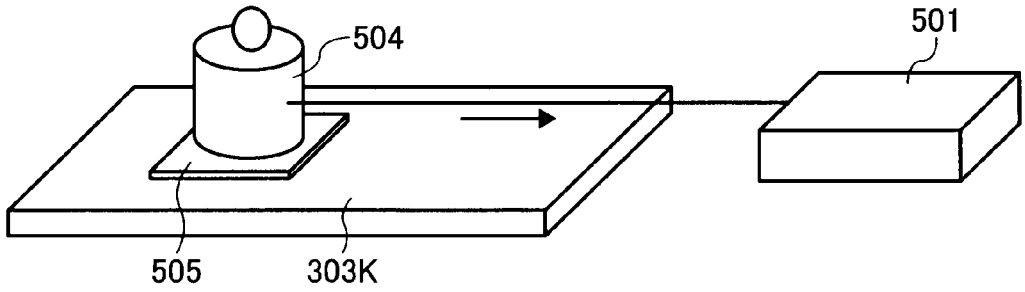
FIG. 9 is a schematic diagram showing a measurement device for measuring the static coefficient of friction of the cleaning blade.

Next, the inventors measured the static coefficient of friction of the cleaning blade 303K that is installed in the K cleaning device 3K as follows. In other words, first, as shown in FIG. 9, polytetrafluoroethylene tape (made by Nippon Denko, Nitoflon 903UL) 505 was placed on the surface of the cleaning blade 303K, and a 100 g weight 504 was placed on the tape. Next, the weight 504 was pulled by a digital push-pull gauge (FGC-2B manufactured by Shimpo) 501. Then, after reading the static friction force F from the gauge just before the weight 504 started to move, the static coefficient of friction was obtained using the reading result and the calculation formula [Static coefficient of friction force $F=\mu N$] (where N=0.98).

Next, the inventors prepared K toner made by the polymerization method as K toner to be set in the K developing device 5K. The volumetric average particle diameter of toner made by the polymerization method is 9 μm or smaller, but the volumetric average particle diameter of the prepared K toner was 8 μm. Also, the average circularity was 0.96.

The average circularity can be measured using a flow-type particle image analyzer FPIA-2000 (made by Toa Iyou Denshi KK). Specifically, 0.1 to 0.5 mL of surfactant, preferably alkylbenzene sulfonate, is added to 100 to 150 mL of water from which solid impurities had been removed in advance in a container. Then about 0.1 to 0.5 g of the material to be measured (toner) is added. Then a dispersal process is carried out with the agitation liquid in which the toner is dispersed using an ultrasonic dispersion device for about one to three minutes. Then with a concentration of dispersion liquid of 3000 to 1 [10,000 particles/μL] the agitation liquid is set in the analysis device, and the toner shape and distribution is measured. Then, based on the measurement results, if the external perimeter of the projected shape of the toner is L1, and the projected area is S, and the perimeter of a perfect circle with the same area as the projected area S is L2, then L2/L1 is obtained, the average value of which is the average circularity.

Also, the volume average particle diameter can be obtained by the Coulter counter method. Specifically, the particle number distribution and the volume distribution data of the toner measured by a Coulter Multisizer 2e (made by Coulter Corporation) is sent via an interface (made by Nikkaki) to a personal computer for analysis. In more detail, an electrolyte of 1% NaCl is prepared using first grade sodium chloride. Then, 0.1 to 5 mL of surfactant as a dispersing agent, preferably alkylbenzene sulfonate, is added to 100 to 150 mL of this electrolyte. Then 2 to 20 mg of the toner that is to be measured is added, and a dispersion process carried out for 1 to 3 minutes using an ultrasonic dispersion device. Then 100 to 200 mL of the electrolyte is placed in a separate beaker, and after carrying out the dispersion process, solvent is added until a predetermined concentration is reached, and placed in the Coulter Multisizer 2e.

A 100 μm aperture is used, and the diameters of 50,000 toner particles are measured.

Thirteen channels are used to measure toner particles between 2.00 μm and 32.0 μm as follows: 2.00 to less than 2.52 μm; 2.52 to less than 3.17 μm; 3.17 to less than 4.00 μm; 4.00 to less than 5.04 μm; 5.04 to less than 6.35 μm; 6.35 to less than 8.00 μm; 8.00 to less than 10.08 μm; 10.08 to less than 12.70 μm; 12.70 to less than 16.00 μm; 16.00 to less than 20.20 μm; 20.20 to less than 25.40 μm; 25.40 to less than 32.00 μm; 32.00 to less than 40.30 μm.

Then, based on the relationship formula [Volume average particle diameter=$\Sigma XfV/\Sigma fV$], the volume average particle diameter is calculated. Here, X is the characteristic diameter for each channel, V is the equivalent volume for the characteristic diameter for each channel, and f is the number of particles in each channel.

The K toner prepared by the inventors contained hydrocarbon release agent. The hydrocarbon release agent is a release agent containing only carbon and hydrogen atoms, so ester radicals, alcohol radicals, amide radicals, and soon, are not contained. Examples include polyethylene, polypropylene, polyethylene and polypropylene copolymers, and other polyolefin waxes, paraffin wax, microcrystalline wax, and other petroleum waxes, Fischer-Tropsch wax, and other synthetic waxes. Among these, polyethylene wax, paraffin wax, and Fischer-Tropsch wax are preferable. Still more preferable are polyethylene wax and paraffin wax.

It is desirable that the quantity of hydrocarbon release agent added to the toner parent material should be in the range 2 to 8 parts by mass for 100 parts by mass of toner to improve the adhesion separation properties. For toner manufactured under these conditions, the result of measuring the quantity of release agent in the vicinity of the surface of the toner parent material by the FTIR-ATR method (Fourier transform infrared-attenuated total reflectance method) is in the range 0.05 to 0.2. The K toner prepared by the inventors had 2.5 parts by mass of hydrocarbon release agent added to 100 parts by mass of toner. The quantity of release agent in the vicinity of the surface of the K toner parent material measured by the FTIR-ATR method (Fourier transform infrared-attenuated total reflectance method) was 0.15.

In the FTIR-ATR method, first 3 g of toner as test material is pressed for one minute under a 6 t load in an automatic pellet former (Type M No. 50 BRP-E, made by Maekawa Testing Machine Mfg. Co., Ltd.). In this way, toner pellets of diameter 40 mm and height about 2 mm are formed. Next, the toner pellet and a 100 μm germanium (Ge) crystal medium are brought into close contact, so that total reflection occurs between the toner pellet and the medium crystal. When total reflection occurs, at the boundary light is slightly reflected into the test specimen (evanescent wave). In the region absorbed by the test specimen, the energy of the reflected light will be reduced corresponding to the strength of absorption. A spectrum is obtained by measuring the reflected light.

Measurement of the reflected light is carried out using a microscopic FTIR device (Perkin Elmer Spectrum One with a MultiScope FTIR unit) under conditions of infrared incidence angle 41.5°, resolution 4 cm −1, integrated 20 times. With this type of measurement it is possible to determine the quantity of release agent within a depth of about 0.3 μm from the surface of the toner.

The bulk density (AD value) of toner made by the polymerization method is about 0.385 or less. It is difficult to make this type of toner drop from the surf ace from a cleaning blade, and the toner easily accumulates on the surface of the blade to form a toner mass. The mass grows to a certain extent, then presses up the cleaning blade, and passes between the blade and the photoconductive member. Then the charging roller that contacts the photoconductive member 2K on the downstream side of the cleaning device 3K in the direction of movement of the surface of the photoconductive member becomes contaminated. The bulk density (AD value) of the toner can be measured using a powder tester (model PT-D) manufactured by Hosokawa Micron.

The inventors prepared a test printer (Ricoh CX3000) having a configuration the same as that in FIG. 1, and set up the photoconductive member 2K, cleaning blade 303K, and K toner in this test printer as explained above. Then 1,000 sheets of recording sheets P were printed with a monochrome test image having an image area ratio of 50%. At this time the conditions were as follows.

| | |
|---|---|
| JIS-A hardness of the cleaning blade 303K: | 70° |
| Percentage rebound resilience of the cleaning blade 303K: | 35% |
| Static coefficient of friction of the cleaning blade 303K: | 1.2 |
| Thickness of the cleaning blade 303K: | 2.0 mm |
| Contact pressure between the blade and the photoconductive member 2K: | 50 N/m |
| Contact angle θ of the blade and photoconductive membeer 2K: | 11° |

After printing out the 1,000 sheets, the inventors next removed the charging roller of the charging device 4K from the printer. Then the extent of toner contamination on the surface of the charging roller was evaluated visually into three stages: no contamination (O); some contamination but not to the extent that images are affected (Δ); and contaminated to the extent that images are affected (X). Then it was possible to confirm the good result that there was no contamination (O). Also, in the printer without the charging roller, by contacting the photoconductive member in the area downstream of the area where the cleaning blade contacts the photoconductive member in the direction of movement of the surface of the photoconductive member with a non-woven fabric, and checking the amount of toner adhering to the non-woven fabric, it is possible to evaluate the performance in cleaning the photoconductive member.

[Test 2]

The contact angle θ between the cleaning blade 303K and the photoconductive member 2K was set to 15°, and the other conditions were the same as in Test 1, and the performance in cleaning the photoconductive member was evaluated. Then it was confirmed that there was a certain amount of contamination but not to the extent of affecting the images (Δ).

[Test 3]

A K photoconductive member 2K in which a surface protection layer, made by dispersing a stilbene compound containing a cross-linked hydroxyl radical in a polycarbonate resin, applying, and drying, covers the charge transport layer was used. The rest of the conditions were the same as in Test 1, and the performance in cleaning the photoconductive member was evaluated. The good result that there was no contamination (O) was confirmed. The measurement result of the static coefficient of friction by the Euler belt method for the photoconductive member 2K used in Test 3 was 0.62.

[Test 4]

A K photoconductive member 2K in which the measurement result for the static coefficient of friction measured by the Euler belt method was 0.5 was used. The rest of the conditions were the same as in Test 1, and the performance in cleaning the photoconductive member was evaluated. The good result that there was no contamination (O) was confirmed.

[Test 5]

A K photoconductive member 2K in which the measurement result for the static coefficient of friction measured by the Euler belt method was 0.4 was used. The rest of the conditions were the same as in Test 1, and the performance in cleaning the photoconductive member was evaluated. The bad result that there was contamination to the extent that images were affected (X) was obtained.

[Test 6]

A K cleaning blade 303K in which the static coefficient of friction was 1.0 was used. The rest of the conditions were the same as in Test 4, and the performance in cleaning the photoconductive member was evaluated. The good result that there was no contamination (O) was confirmed.

[Test 7]

A K cleaning blade 303K in which the static coefficient of friction was 0.9 was used. The rest of the conditions were the same as in Test 4, and the performance in cleaning the photoconductive member was evaluated. The bad result that there was contamination to the extent that images were affected (X) was obtained.

[Test 8]

A K cleaning blade 303K in which the static coefficient of friction was 0.5 was used. The rest of the conditions were the same as in Test 1, and the performance in cleaning the photoconductive member was evaluated. The bad result that there was contamination to the extent that images were affected (X) was obtained.

[Test 9]

A K cleaning blade 303K in which the static coefficient of friction was 2.0 was used. The rest of the conditions were the same as in Test 1, and the performance in cleaning the photoconductive member was evaluated. The good result that there was no contamination (O) was confirmed.

[Test 10]

A K cleaning blade 303K in which the static coefficient of friction was 2.1 was used. The rest of the conditions were the same as in Test 1, and the performance in cleaning the photoconductive member was evaluated. However, during the print out the cleaning blade 303K turned over, so it was not possible to correctly evaluate the performance in cleaning the photoconductive member.

The test results are shown in FIG. 10.

From FIG. 10 it can be seen that to obtain good cleaning performance, a photoconductive member 2K with a static coefficient of friction of 0.5 or greater and a cleaning blade 303K with a static coefficient of friction in the range 1.0 to 2.0 should be used.

Next, the characteristic configuration of the printer according to the present embodiment is explained.

In the printer, photoconductive members 2Y, M, C, K of each process unit 1Y, M, C, K having a static coefficient of friction measured in accordance with the Euler belt coefficient of friction measurement method of 0.5 or greater are used. Also, cleaning blades in each process unit 1Y, M, C, K having a static coefficient of friction measured based on the measured results for static friction force from a digital push-pull gauge in the range 1.0 to 2.0 are used. In this configuration, as can be seen from the results of Tests 1 through 10, spherical toner made by the polymerization method adhering to the surface of the photoconductive members 2Y, M, C, K can be cleaned well by the respective cleaning blades. This effect has been achieved by using photoconductive members and cleaning blades with certain levels of static coefficient of friction. The cleaning blades are vigorously vibrated by the friction between the two, so it is possible to effectively make the accumulated toner drop from the surface of the blade.

So far a tandem type printer in which toner images in different colors formed on a plurality of photoconductive members are superposed onto an intermediate transfer member to form another color image has been explained. However, the present invention can also be applied to the following types of image forming device. That is, an image forming device in which toner images in different colors are formed successively on a single photoconductive member, and are successively transferred and superposed onto an intermediate transfer member to form an image in another color.

Also, the present invention can also be applied to an image forming device that forms images in a single color, without forming images in other colors.

Also, a printer in which toner that remains adhering to a drum shaped photoconductive member as image carrier is removed after transfer by the cleaning blade has been explained. However, the present invention can also be applied to an image forming device in which toner adhering to a belt shaped photoconductive member is removed by a cleaning blade. Furthermore, the present invention can also be applied to an image forming device in which toner adhering to the intermediate transfer member which is an image carrier is removed by a cleaning blade.

In the printer according to the present embodiment, cleaning blades in each process unit 1Y, M, C, K having thicknesses in the range 1.5 to 2.5 mm are used. In the configuration the amount of bending deformation in the cleaning blade due to being pressed against the photoconductive member is maintained within a certain range. In this way reduction of the contact pressure between the blade and the photoconductive member due to bending deformation is limited, and the cleaning performance can be stabilized and improved.

Also, in the printer according to the present embodiment, cleaning blades of each processing unit 1Y, M, C, K with a hardness (JIS-A) in the range 60 to 80 degrees are used. By having the hardness equal to or greater than 60 degrees unwanted elastic deformation is prevented, and by having the hardness less than or equal to 80 degrees the blade can exhibit a certain level of friction force.

Also, in the printer according to the present embodiment, the cleaning blades of each process unit 1Y, M, C, K contact the photoconductive member at a contact angle θ of 5° or greater. In this configuration, the contact area between the cleaning blade and the photoconductive member is maintained within a certain range. Therefore it is possible to avoid reduction in the contact pressure between the blade and the photoconductive member due to the contact area increasing unnecessarily.

Also, in the printer according to the present embodiment, photoconductive members 2Y, M, C, K in which a charge transport layer containing polycarbonate resin is formed on the surface of the base either directly, or with several layers between the charge transport layer and the base, are used. In this configuration, charge transporting capability is provided near the surface of the photoconductive member, while the polycarbonate resin limits the wear of the charge transport layer, so the charge transport capability can be stably maintained over a long period of time.

The photoconductive members 2Y, M, C, K may have a multi-layer structure in which a plurality of layers are formed on the base, and the surface layer is made from a material whose hardness is higher than the hardness of the first two layers below the surface layer, which are the charge transport layer and the charge generation layer. In this case, due to the high hardness surface layer it is possible to avoid wear due to friction of the blade with the second layer and lower layers including the charge generation layer and the charge transport layer.

Various modifications will become possible for those skilled in the art after receiving the teachings of the present disclosure without departing from the scope thereof.

What is claimed is:

1. An image forming device, comprising:

toner image forming means that forms toner images on the surface of an image carrier;

transfer means that transfers the toner images on the surface of the image carrier onto a transfer member; and a plate shaped cleaning blade configured to contact the surface of the image carrier and scrape off residual toner remaining on the surface of the image carrier after the transfer process by the transfer means has been completed, wherein the surface of the image carrier has a static coefficient of friction with a sheet as measured by the Euler belt type coefficient of friction measurement method of 0.5 or greater, and the cleaning blade has a static coefficient of friction with a surface consisting essentially of polytetrafluoroethylene in the range 1.0 to 2.0.

2. The image forming device as claimed in claim 1, wherein the cleaning blade has a thickness in the range 1.5 to 2.5 mm.

3. The image forming device as claimed in claim 1, wherein the cleaning blade has a hardness (JIS-A) in the range 60 to 80 degrees.

4. The image forming device as claimed in claim 1, wherein a contact angle between the cleaning blade and the image carrier is set to 5° or greater.

5. The image forming device as claimed in claim 1, wherein the image carrier has a charge transport layer containing polycarbonate resin, formed directly or via a plurality of layers on a surface of a base.

6. The image forming device as claimed in claim 1, wherein the image carrier has a multi-layer structure in which a plurality of layers are formed on a surface of a base, and a surface layer is made from a material whose hardness is higher than the two layers below the surface layer.

7. The image forming device as claimed in claim 1, wherein the sheet used in the Euler belt type coefficient of friction measurement method is a sheet of paper.

8. The image forming device as claimed in claim 1, wherein the static coefficient of friction of said cleaning blade is obtained based on a measurement result of static friction force using a digital push-pull gauge.

9. The image forming device as claimed in claim 1, wherein the surface consisting essentially of polytetrafluoroethylene is a surface of a polytetrafluoroethylene tape.

10. A process unit in an image forming device which comprises toner image forming means that forms toner images on a surface of an image carrier, transfer means that transfers the toner images on the surface of the image carrier onto a transfer member, and a plate shaped cleaning blade configured to contact the surface of the image carrier and scrape off residual toner remaining on the surface after the transfer process by the transfer means has been completed, the process unit being inserted into and removed from a main body of the image forming device as a single unit comprising at least the image carrier and the cleaning blade held in a common holding member, wherein the image carrier has a static coefficient of friction with a sheet as measured by the Euler belt type coefficient of friction measurement method of 0.5 or greater, and the cleaning blade has a static coefficient of friction with a surface consisting essentially of polytetrafluoroethylene in the range 1.0 to 2.0.

11. The process unit as claimed in claim 10, wherein the sheet used in the Euler belt type coefficient of friction measurement method is a sheet of paper.

12. The process unit as claimed in claim 10, wherein the static coefficient of friction of said cleaning blade is obtained based on a measurement result of static friction force using a digital push-pull gauge.

13. An image forming method, comprising:

a toner image forming step of forming toner images on a surface of an image carrier;

a transfer step of transferring the toner images on the surface of the image carrier onto a transfer member; and a removal step of removing residual toner remaining on the surface of the image carrier after the transfer step has been completed, including scraping off the residual toner on the surface of the image carrier using a plate shaped cleaning blade which contacts the surface, the image carrier having a static coefficient of friction with a sheet as measured by the Euler belt type coefficient of friction measurement method of 0.5 or greater, and the cleaning blade having a static coefficient of friction with a surface consisting essentially of polytetrafluoroethylene in the range 1.0 to 2.0.

14. The image forming method as claimed in claim 13, wherein the toner for forming the toner images has a volume average particle diameter of 9 μm or smaller.

15. The image forming method as claimed in claim 14, wherein the toner has an average circularity of 0.96 or greater.

16. The image forming method as claimed in claim 15, wherein the toner has a bulk density of 0.385 or less.

17. The image forming method as claimed in claim 14, wherein the toner contains release agent in the range 2 to 8 weight percent.

18. The image forming method as claimed in claim 17, wherein a quantity of the release agent in the vicinity of the surface of toner particles as measured by the Fourier transform infrared-attenuated total reflectance method is within the range 0.05 to 0.5.

19. The image forming method as claimed in claim 13, wherein the sheet used in the Euler belt type coefficient of friction measurement method is a sheet of paper.

20. The image forming method as claimed in claim 13, wherein the static coefficient of friction of said cleaning blade is obtained based on a measurement result of static friction force using a digital push-pull gauge.

* * * * *